US005569978A

United States Patent [19]

Oiye et al.

[11] Patent Number: 5,569,978

[45] Date of Patent: Oct. 29, 1996

[54] FLASH LAMP WITH O-RING ELECTRODE SEALS

[75] Inventors: George Oiye, Los Altos; Joseph R. Caruso, San Martin, both of Calif.

[73] Assignee: ILC Technology, Inc., Sunnyvale, Calif.

[21] Appl. No.: 427,688

[22] Filed: Apr. 24, 1995

Related U.S. Application Data

[63] Continuation of Ser. No. 229,688, Apr. 19, 1994, abandoned.

[51] Int. Cl.[6] ..... H01J 61/06

[52] U.S. Cl. ..... 313/631; 313/623; 313/632

[58] Field of Search ..... 313/623, 631–632

[56] References Cited

U.S. PATENT DOCUMENTS

| | | | |
|---|---|---|---|
| 2,459,579 | 8/1947 | Noel | 313/631 |
| 3,984,719 | 10/1976 | Grasis et al. | 313/217 |
| 4,038,578 | 7/1977 | Mattijssen | 313/623 |

FOREIGN PATENT DOCUMENTS

| | | | |
|---|---|---|---|
| 0857664 | 12/1952 | Germany | 313/631 |
| 0857665 | 12/1952 | Germany | 313/631 |
| 2038310 | 7/1980 | United Kingdom | 313/623 |
| 2107921 | 5/1983 | United Kingdom | 313/631 |

*Primary Examiner*—Sandra L. O'Shea
*Assistant Examiner*—Matthew J. Esserman
*Attorney, Agent, or Firm*—Law Offices of Thomas E. Schatzel A Prof. Corporation

[57] ABSTRACT

An arc lamp comprises an electrode assembly with O-ring seals that seal in xenon gas within a glass tube envelope and shaped electrode that, together with a contoured tube geometry inside the glass tube envelope near the electrode, will aerodynamically redirect the supersonic forces of gas ignition to reduce the mechanical impact pulses that would otherwise ultimately work the electrode assembly out of the end of the glass the envelope.

12 Claims, 1 Drawing Sheet

FLASH LAMP WITH O-RING ELECTRODE SEALS

This is a continuation of application Ser. No. 08/229,688 filed on Apr. 19, 1994, now abandoned.

BACKGROUND OF THE INVENTION

1. Field of the Invention

The invention relates generally to electric gaseous discharge lamps and specifically to the construction and sealing of electrodes for such lamps within their glass tubes.

2. Description of the Prior Art

A gas-filled discharge lamp typically has an internal pressure of one atmosphere that will rise suddenly to approximately ten atmospheres when the gas is first ignited into a plasma by an electrical arc between electrodes.

U.S. Pat. No. 3,984,719, issued Oct. 5, 1976, to Egils M. Grasis, and one of the present inventors, Joseph R. Caruso, describes an internally sealed lamp that has its electrodes sealed within a glass tube envelope with elastomer O-rings. Such a system of envelope sealing has substantial positive economic benefits in the manufacture of large lamps.

Unfortunately, the pulsing that occurs each time a lamp ignites acts as an impact hammer against such O-ring seals and will ultimately force the seals and electrodes out of the glass envelope.

Prior art O-ring seal pump-down tubulations have been a challenge to make simple, neat electrical connections. The pinched-off end of the fill tube has been difficult to attach directly, and good electrical connections are needed to carry high peak currents and to reduce radio frequency emissions. Such electrical connections must also be simple to make and inexpensive to fabricate.

Prior art gaseous discharge lamps conventionally use metal bases, such as aluminum, for mounting. Such metal bases complicate the insulation system that is required to stand-off the very high voltages associated with such lamps, e.g., sixty thousand volts. A simplified insulation system is therefore needed to reduce overall lamp costs.

SUMMARY OF THE PRESENT INVENTION

It is therefore an object of the present invention to provide a sealing system for a glass envelope flash-lamp that can withstand numerous ignition cycles without affecting the position of an O-ring seal.

It is a further object of the present invention to provide an economical-to-manufacture gaseous discharge lamp.

Briefly, an arc lamp embodiment of the present invention comprises an electrode assembly with O-ring seals that seal in xenon gas within a glass tube envelope and shaped electrode that, together with a contoured tube geometry inside the glass tube envelope near the electrode, will aerodynamically redirect the sonic forces of gas ignition to reduce the mechanical impact pulses that would otherwise ultimately work the electrode assembly out of the end of the glass tube envelope.

An advantage of the present invention is that a lamp is provided that is economical to manufacture.

Another advantage of the present invention is that a lamp is provided with an effective and simple insulation system.

A further advantage of the present invention is that an aerodynamically-shaped electrode assembly is provided that reshapes and redirects the sonic shock waves created by gas ignition within a gaseous discharge tube to flow through a supersonic nozzle section created by the glass tube to generate a negative mechanical force on the electrode.

An expected advantage of the present invention is that a lamp with aerodynamically-shaped electrodes is provided that starts easier, centers its plasma in a stable area, and has a longer life.

These and other objects and advantages of the present invention will no doubt become obvious to those of ordinary skill in the art after having read the following detailed description of the preferred embodiment which is illustrated in the various drawing figures.

IN THE DRAWINGS

FIG. 1 is a cross-sectional view of a flash lamp embodiment of the present invention; and FIG. 2 is a cross-sectional view of one end of the flash lamp of FIG. 1 and shows the construction details of one of two electrode assemblies.

DETAILED DESCRIPTION OF THE PREFERRED EMBODIMENTS

Figure 1:
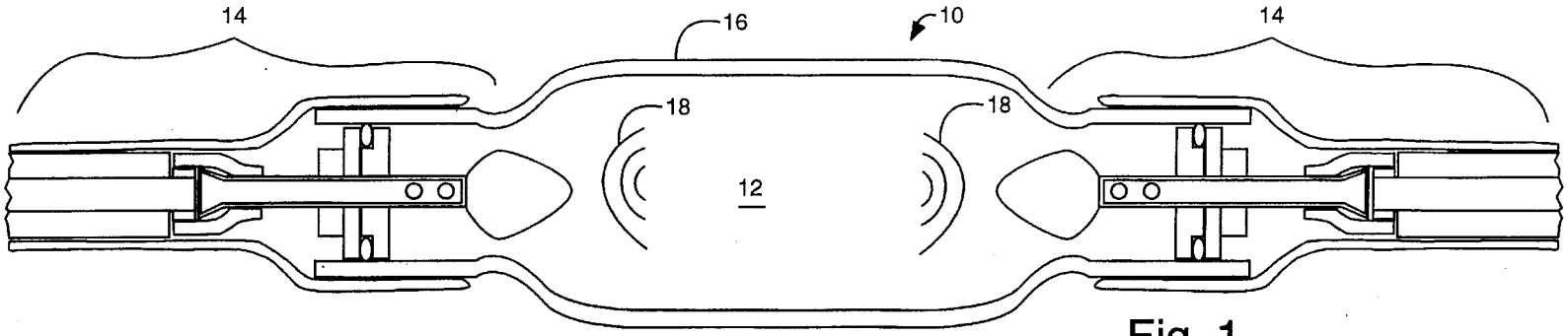
Figure 2:
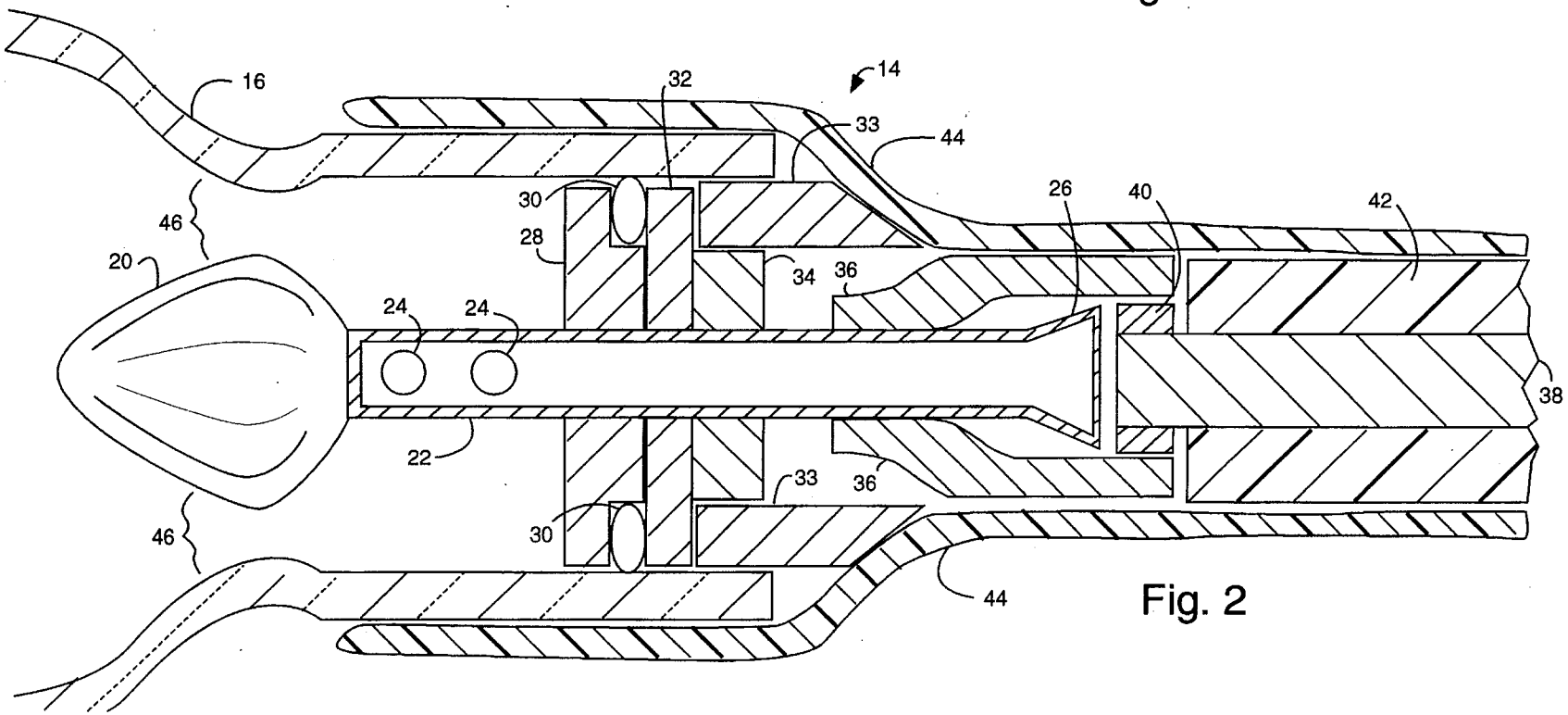

FIG. 1 illustrates a flash lamp embodiment of the present invention, referred to herein by the general reference numeral 10. Lamp 10 is filled with an inert gas 12, e.g., xenon or krypton, and has a pair of electrode assemblies 14 that are similar to one another and mounted within respective ends of a glass envelope 16. Quartz may be used for the construction of the glass envelope 16 and may generally take the shape of a tube.

During operation, an electric voltage is applied between the electrode assemblies 14 of sufficient magnitude to cause an arc to jump through the inert gas 12 and to create a plasma that radiates light. Once ignited, the current through lamp 10 is controlled to limit the effects of the negative resistance characteristic which is common to gaseous discharge lamps. During ignition, a sonic shock wave 18 radiates out from the plasma being formed and mechanically pulses the electrode assemblies 14. If left uncontrolled, shock wave 18 would eventually operate to migrate each electrode assembly 14 out of its respective end of the glass envelope 16.

Each electrode assembly 14 comprises a metal electrode 20 mounted to a hollow metal tube 22 that has at least one port hole 24 that opens the inside of the tube 22 to the inside of glass envelope 16. A pinched-off end 26 of the tube 22 allows the inert gas 12 to be filled within the lamp 10 during assembly and to then seal the gas within. A fixed pressure plate 28 is attached to the tube 22 and is configured to pinch an O-ring 30 between it and a movable pressure plate 32. An additional back stop 33 may alternatively be epoxied in to provide a positive stop. A machine nut 34 is threaded to the tube 22 and when tightened will press against the movable pressure plate 32 and to thus cause the O-ring 30 to expand and seal the electrode assembly 14 against the inside of the glass envelope 16. The O-ring 30 may comprise any of a number of elastic materials, including silicone. The O-ring 30 may also be replaced by a flat disk of elastic material. The inside of the glass envelope 16 may be etched or otherwise roughened to improve the grip of the O-ring 30 to the glass, envelope 16 to better resist the effects of the shock wave 18.

U.S. Pat. No. 3,984,719, issued Oct. 5, 1976, to Grasis, et al., provides useful information on the sealing of electrode assemblies to flash lamp envelopes and is therefore incorporated herein by reference.

The electrode assemblies 14 each further comprise a copper bell ferrule 36 that is slipped over the tube 22 before the lamp 10 is filled with the inert gas 12 and the pinched-off end 26 is formed. Subsequent to gas filling, ferrule 36 is slipped over the pinched-off end 26 and soldered in place to the tube 22. An electrical wire 38 has soldered to it a cable-end ferrule 40 that is subsequently soldered inside the bell ferrule 36. A sleeve insulation 42 is heat-shrinked over the wire 38 and an outer insulating jacket 44 is heat-shrinked over the end of the glass envelope 16, ferrule 36, back stop 33 and the sleeve insulation 42. The insulation provided will preferably stand-off sixty thousand volts (60 KV).

The electrode 20 is shaped aerodynamically to form part of a supersonic nozzle which is further defined by the inner funneling of the glass envelope 16, e.g., in an annular area 46. Such a supersonic nozzling is intended to control the sonic shock wave 18. The outward expulsive forces are redirected such that a counteracting mechanical force is created that pushes the electrode assemblies 14 together toward the center of the lamp 10. These counter-acting forces help prevent the O-rings 30 from slipping.

It is generally understood by the present inventors that the present invention is of particular use in arc lamps and flash lamps with glass bores greater than one-quarter of an inch. Various bore sizes for the glass envelope 16 have been considered, including a center bore of forty-three millimeters, an annulus area 46 inside diameter of twenty-five millimeters, and a inside diameter of thirty millimeters for the area of envelope 16 sealed by the O-rings 30. The geometry in the vicinity of annular area 46 and the shape of electrode 20 are empirically derived, with the reduction of the mechanical impact force on electrode assembly 14 being a principal design objective.

The present invention also includes the construct methods used to build lamp 10. For example, a method of maintaining the seal of an electrode assembly within gaseous discharge lamps where the electrode assembly is subject to expulsive forces caused by single or repeated gas ignition of the lamp, includes the step of shaping a gaseous discharge lamp electrode to aerodynamically redirect gas ignition shock wave forces to reduce the expulsive effects on the electrode in the lamp. The method can further include a step for shaping the inside geometry of a glass tube envelope proximate to the gaseous discharge lamp electrode to aerodynamically redirect gas ignition shock wave forces to reduce the expulsive effects on the electrode in the lamp.

Another fabrication method for filling and sealing an inert gas within a gaseous discharge lamp and for making an electrical connection to an electrode within the lamp, includes the steps of slipping a metal bell ferrule over a metal fill tube connected to the inside of a glass tube envelope of the lamp, filling the lamp, with the inert gas through the metal fill tube, pinching-off an outside end of the metal fill tube to seal the inert gas within the glass tube envelope, slipping the metal bell ferrule over the pinched-off end of the metal fill tube, and soldering the metal bell ferrule to the metal fill tube.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An electrode assembly for insertion in the open end of a glass tube envelope of a gas-filled gaseous discharge lamp, comprising:

an arc electrode having a first end for facing an electric arc and a supersonic shock wave generated by said electric arc in an inert gas and a second end opposite to said first end;

aerodynamic supersonic nozzle means annularly disposed, at least in part, in the arc electrode and encircling the arc electrode, and including funneling and nozzling means for redirecting outward expulsive forces of said shock wave acting on said first end of the electrode into a counteracting mechanical force applied to said second end of the electrode for pushing the electrode toward said electric arc; and an elastic compression seal assembly for supporting the arc electrode and for sealing said inert gas within said glass tube envelope.

2. The electrode assembly of claim 1, further comprising:

a metal tube passing through the elastic compression seal assembly and having an opening for filling said lamp with said gas after the electrode assembly is in place within said glass tube envelope; and a pinched-off end of the metal tube for sealing said gas within said glass tube envelope.

3. The electrode assembly of claim 2, further comprising:

a metal bell ferrule having a first inside diameter at one end that slips over the metal tube and a second inside diameter at an opposite end that slips over the pinched-off end.

4. The electrode assembly of claim 3, further comprising:

a wire ferrule having an inside diameter for accepting an electrical wire and an outside diameter for electrical attachment to the metal bell ferrule.

5. The electrode assembly of claim 4, further comprising:

an insulating sleeve covering said electrical wire and abutting the wire ferrule.

6. The electrode assembly of claim 5, further comprising:

an insulating jacket covering an end of said glass tube, the metal bell ferrule, the wire ferrule, the electrical wire and the insulating sleeve.

7. A gas-filled gaseous discharge lamp, comprising:

a glass tube envelope filled with an inert gas;

an arc electrode disposed in said inert gas and having a first end for facing an electric arc and a supersonic shock wave generated by said electric arc in said inert gas and a second end opposite to said first end;

aerodynamic supersonic nozzle means annularly disposed, at least in part, in the arc electrode and encircling the arc electrode, and including funneling and nozzling means for redirecting outward expulsive forces of said shock wave acting on said first end of the electrode into a counteracting mechanical force applied to said second end of the electrode for pushing the electrode toward said electric arc;

an elastic compression seal assembly that supports the arc electrode and that provides for sealing said inert gas within the glass tube envelope;

a metal tube passing through the elastic compression seal assembly and having an opening for filling said lamp with said inert gas after the electrode assembly is in place within the glass tube envelope;

a pinched-off end of the metal tube for sealing said inert gas within the glass tube envelope;

a metal bell ferrule having a first inside diameter at one end that slips over the metal tube and a second inside diameter at an opposite end that slips over the pinched-off end;

a wire ferrule having an inside diameter for accepting an electrical wire and an outside diameter for electrical attachment to the metal bell ferrule;

an insulating sleeve covering said electrical wire and abutting the wire ferrule; and an insulating jacket covering an end of said glass tube, the metal bell ferrule, the wire ferrule, the electrical wire and the insulating sleeve.

8. The lamp of claim 7, wherein:

the glass tube envelope has a funneling and nozzling geometry in the area of the arc electrode providing for an aerodynamic focusing of said gas ignition forces to further reduce the mechanical impact forces acting on said face of the arc electrode.

9. An electrode assembly for insertion in an open end of a glass tube envelope of a gas-filled gaseous discharge lamp, comprising:

an arc electrode; and an elastic compression seal assembly that supports the arc electrode for sealing said gas within said glass tube envelope;

a metal tube passing through the elastic compression seal assembly and having an opening for filling said lamp with said gas after the electrode assembly is in place within said glass tube envelope;

a pinched-off end of the metal tube for sealing said gas within said glass tube envelope; and a metal bell ferrule having a first inside diameter at one end that slips over the metal tube and a second inside diameter at an opposite end that slips over the pinched-off end.

10. The electrode assembly of claim 9, further comprising:

a wire ferrule having an inside diameter for accepting an electrical wire and an outside diameter for electrical attachment to the metal bell ferrule.

11. The electrode assembly of claim 10, further comprising:

an insulating sleeve covering said electrical wire and abutting the wire ferrule.

12. The electrode assembly of claim 11, further comprising:

an insulating jacket covering an end of said glass tube, the metal bell ferrule, the wire ferrule, the electrical wire and the insulating sleeve.

* * * * *